US007043046B2

(12) United States Patent
Frasl

(10) Patent No.: US 7,043,046 B2
(45) Date of Patent: May 9, 2006

(54) METHOD FOR MANUFACTURING AN ELECTROACOUSTICAL TRANSDUCER COMPRISING A MEMBRANE CONFIGURATION

(75) Inventor: Ewald Frasl, Biedermannsdorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/931,111

(22) Filed: Aug. 30, 2004

(65) Prior Publication Data

US 2005/0028348 A1 Feb. 10, 2005

Related U.S. Application Data

(62) Division of application No. 10/071,371, filed on Feb. 8, 2002, now Pat. No. 6,799,361.

(30) Foreign Application Priority Data

Feb. 13, 2001 (EP) ..... 01890037

(51) Int. Cl.
*H04R 1/00* (2006.01)
*H04R 7/00* (2006.01)

(52) U.S. Cl. ..... 381/398; 381/423; 181/171

(58) Field of Classification Search ..... 381/386, 381/391, 189, 398, 412, 419, 420, 423, 424, 381/430–433; 181/171, 172, 173; 29/594, 29/602.1, 609.1
See application file for complete search history.

(56) References Cited

U.S. PATENT DOCUMENTS 5,157,731 A * 10/1992 Mitobe ..... 381/420
5,892,185 A * 4/1999 Takahashi et al. ..... 181/171
6,799,361 B1 * 10/2004 Frasl ..... 29/594

* cited by examiner

*Primary Examiner*—Sinh Tran
*Assistant Examiner*—Brian Ensey
(74) *Attorney, Agent, or Firm*—Peter Zawilski

(57) ABSTRACT

In an electroacoustic transducer (21) with a stationary transducer part (23) and with a membrane configuration (17) comprising a membrane (15) and a handling ring (1) for the membrane (15) connected with the membrane (15), the membrane configuration (17) is connected with the stationary transducer part (23) via the handling ring (1), and the handling ring (1) and membrane (15) are connected together via an interlocking connection.

1 Claim, 2 Drawing Sheets

METHOD FOR MANUFACTURING AN ELECTROACOUSTICAL TRANSDUCER COMPRISING A MEMBRANE CONFIGURATION

CROSS REFERENCE TO RELATED APPLICATIONS

This is a divisional of application Ser. No. 10/071371, filed Feb. 8, 2002 now U.S. Pat. No. 6,799,316.

The invention relates to a method of manufacturing an electroacoustic transducer, by which method a membrane configuration is produced which comprises a membrane and a handling ring attached to the membrane and which is manufactured by a deep-drawing method in which a piece of foil is formed in a deep-drawing mold and the membrane is formed from part of said piece of foil, and in addition the molded piece of foil is connected to the handling ring inserted in the deep-drawing mold, the intermediate product resulting from a connection of the handling ring to the molded piece of foil is removed from the mold, and subsequently any surplus foil portion is separated from the intermediate product, which results in the membrane configuration being obtained.

The invention also relates to an electroacoustic transducer with a stationary transducer part and a membrane configuration comprising a membrane and a handling ring for the membrane connected to the membrane, wherein the membrane configuration is connected to the stationary transducer part by means of the handling ring.

The invention also relates to a membrane configuration for an electroacoustic transducer comprising a membrane and a handling ring for the membrane connected to the membrane.

A method with the process steps given in the first paragraph above has been used by the applicant for several years, has been demonstrated to a large number of interested parties and customers, and is accordingly known. An electroacoustic transducer according to the design given in the second paragraph above and a membrane configuration according to the design given in the third paragraph above are also known, because such an electroacoustic transducer with such a membrane configuration has been supplied by the applicant to customers of the applicant and fitted by these customers in electroacoustic devices, for example mobile telephones, which devices have subsequently been brought onto the market.

In the known method, a piece of foil intended for the manufacture of the membrane is first fed to a deep-drawing mold and subsequently shaped in this mold such that part of the piece of foil is formed into the membrane. After this deep-drawing process, the handling ring is brought into the mold essentially in the axial direction of the deep-drawing mold by means of a gripping and adjustment device, which handling ring, when it is introduced into the deep-drawing mold, is first fitted with a layer of a hot-melt adhesive on its axial limiting ring surface facing the molded film. Bringing the handling ring with hot-melt adhesive into the deep-drawing mold leads to a melting of the adhesive because the deep-drawing mold is heated in a known manner, with the result that, when reaching the molded piece of foil, the adhesive has such a soft consistency that an adhesive connection is created between the handling ring and the molded piece of foil, i.e. in that the handling ring is briefly pressed against the piece of foil by means of the gripping and adjustment device, thus creating the adhesive joint. After the adhesive joint has been made, the intermediate product formed from the handling ring and molded piece of foil is removed from the deep-drawing mold by the gripping and adjustment device. The surplus foil portion projecting beyond the handling ring is then separated in that the surplus foil portion is cut away by means of a laser cutting device from the useful portion forming the membrane. After cutting with the laser cutting device has yielded the complete membrane configuration, the manufacture of the electroacoustic transducer continues in that the membrane is connected to a moving coil necessary for driving the membrane, and subsequently the axial limiting ring surface of the handling ring is placed with its area lying freely opposite the membrane on a stationary part of the electroacoustic transducer, whereupon the membrane configuration and the moving coil are attached to the stationary part of the transducer via a transducer housing.

In the known method, the problem arises that excess adhesive may be expelled upon joining together of the piece of foil formed in the deep-drawing mold and the handling ring fitted with an adhesive layer, both in the area of the inner radial limiting ring surface of the handling ring and in the area of the outer radial limiting ring surface of the handling ring. The escape of excess adhesive in the area of the inner radial limiting ring surface of the handling ring disadvantageously leads to a reduction in the surface area of the membrane which is capable of oscillation, which is disadvantageous from an acoustic point of view. The escape of excess adhesive in the area of the outer radial limiting surface of the handling ring disadvantageously leads to an undesirable soiling of the gripping and adjustment device necessary for handling the membrane configuration, which is also unfavorable. Another problem arises in the known method in that it is only after molding of the piece of foil that the handling ring is placed with its adhesive layer on the molded piece of foil by a gripping and adjustment device, with the result that the precise radial positioning of the handling ring in relation to the molded piece of foil is dependent on the tolerances on the part of the gripping and adjustment device, which may mean that the handling ring and molded piece of foil and hence finally the membrane are not centered with respect to each other with sufficient precision, which is also disadvantageous and undesirable.

In the known transducer with a membrane configuration manufactured by the method described above, the disadvantages are that the oscillating surface area of the membrane is reduced owing to the escaping excess adhesive in the area of the inner radial limiting ring surface of the handling ring, which has an unfavorable effect on the acoustic behavior, and that an undesirable radial offset may occur between the handling ring and the membrane, which is also unfavorable.

The invention has for its object to avoid the difficulties identified above and to provide an improved method of manufacturing an electroacoustic transducer as well as an improved acoustic transducer and an improved membrane configuration for an electroacoustic transducer.

To achieve this object in a method according to the invention, features according to the invention are provided such that a method according to the invention can be characterized in the manner given below, as follows:

A method of manufacturing an electroacoustic transducer, by which method a membrane configuration is produced, which membrane configuration consists of a membrane and a handling ring for the membrane connected to the membrane, and which membrane configuration is manufactured by a deep-drawing method in which a piece of foil for the manufacture of the membrane is shaped in a deep-drawing mold and is partly molded into the membrane therein and in addition is connected to the handling ring inserted in the deep-drawing mold, whereupon the handling ring and the molded piece of foil connected thereto are removed from the deep-drawing mold, and subsequently any surplus foil portion is separated and the membrane configuration is obtained as a result, wherein in the deep-drawing process the handling ring is first introduced into the deep-drawing mold and brought to rest with a first axial limiting ring surface on an annular axial limiting mold surface of the deep-drawing mold, whereupon the piece of foil is shaped in the deep-drawing mold such that an interlocking connection is created between the handling ring and a portion of the piece of foil, which foil portion forms part of the membrane configuration, during molding of the piece of foil.

To achieve the object given above as regards an electroacoustic transducer according to the invention, features are provided such that an electroacoustic transducer according to the invention can be characterized in the following manner:

An electroacoustic transducer with a stationary transducer part and a membrane configuration comprising a membrane and a handling ring for the membrane connected to the membrane, wherein the membrane configuration is attached to the stationary transducer part by means of the handling ring, and wherein the handling ring and the membrane are joined together by means of an interlocking connection.

To achieve the object given above in a membrane configuration according to the invention intended for an electroacoustic transducer, features are provided such that a membrane configuration according to the invention can be characterized as follows:

A membrane configuration for an electroacoustic transducer, which membrane configuration comprises a membrane and a handling ring for the membrane connected to the membrane, wherein the handling ring and membrane are joined together by means of an interlocking connection.

With the features according to the invention, a method according to the invention achieves in a simple manner the connection between the handling ring and the molded piece of foil, and consequently the membrane as the end product, without the need for an adhesive, as this connection can advantageously be produced by an interlocking fit. Such an interlocking connection is sufficiently stable to guarantee a perfect, uncomplicated, and fault-free handling of the membrane configuration. It also ensures that no undesirable reduction in the surface area of the membrane which is capable of oscillation can occur and prevents an undesirable soiling of the gripping and adjustment device for adjustment and transporting of the membrane configuration.

It should be mentioned here that the manufacture of such a membrane configuration during the manufacture of an electroacoustic transducer is essential if the membrane is made from a film which is particularly thin. Applicant is presently engaged in the development of small electroacoustic transducers with an external diameter of no more than approximately 5 to 7 mm, the membranes of which are made from a film material with a starting thickness of 20 μm, which will subsequently have a final thickness in the range of 5 to 8 μm. Such membranes, which consist, for example, of polycarbonate, cannot be handled by themselves, each such membrane can only be manipulated in combination with a handling ring.

In a method according to the invention, the interlocking connection between the handling ring and the membrane can be created in various ways. It was found to be particularly advantageous, however, if the piece of foil is brought into contact with the handling ring in the area of an inner radial limiting ring surface and in the area of the first axial limiting ring surface and in the area of the second axial limiting ring surface of the handling ring so as to produce the interlocking connection, i.e. if the interlocking connection is formed by the piece of foil engaging behind the handling ring.

Such an engagement can be achieved in a particularly simple manner by a method in which the handling ring introduced into the deep-drawing mold is positioned in axial directions by means of an annular axial limiting mold surface of the deep-drawing mold, the diameter of the radial inner limiting edge of said axial limiting mold surface being greater than the diameter of the inner radial limiting ring surface of the handling ring.

In a method according to the invention, it was also found to be particularly advantageous if the handling ring inserted into the deep-drawing mold is positioned in radial directions by means of a radial limiting mold surface of the deep-drawing mold which cooperates with an outer radial limiting ring surface of the handling ring. This ensures that the handling ring is positioned in a precisely centered position in relation to the membrane to be formed subsequently, which means that the membrane and the handling ring supporting the membrane are positioned precisely centrally with respect to each other in the completed membrane configuration and consequently in a completed electroacoustic transducer, which is advantageous for achieving the highest possible quality of acoustic behavior of the electroacoustic transducer.

The above advantages explained in connection with the method according to the invention apply equally for an electroacoustic transducer according to the invention and a membrane configuration according to the invention.

The aspects detailed above and further aspects of the invention will become evident from the embodiment as described below and will be explained with reference to this embodiment.

The invention will be described below with reference to an embodiment shown in the drawing to which, however, the invention is not limited.

Figure 1:
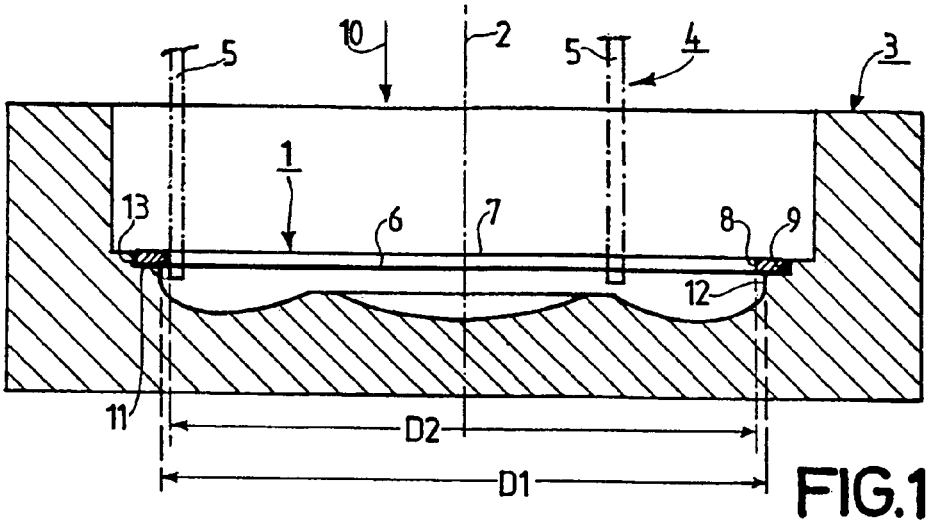
FIG. 1 shows a situation during a process step in a method according to an embodiment of the invention.
Figure 2:
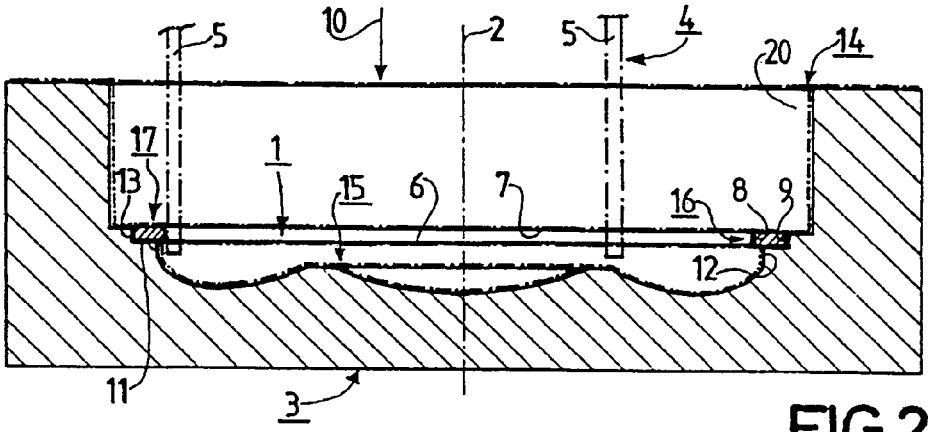
FIG. 2 shows in a manner similar to FIG. 1 a situation during a further process step in the method according to the embodiment of the invention.
Figure 3:
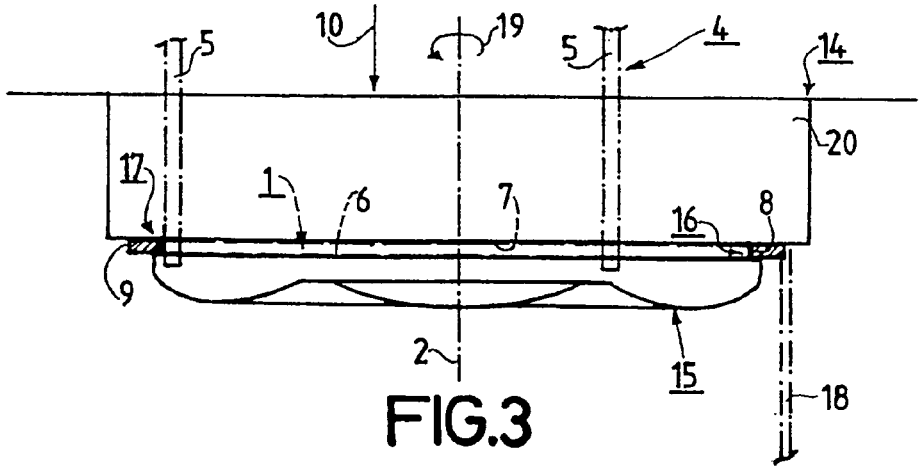

FIG. 3 in a manner similar to FIGS. 1 and 2 shows a situation during a further process step in the method according to the embodiment of the invention.

Figure 4:
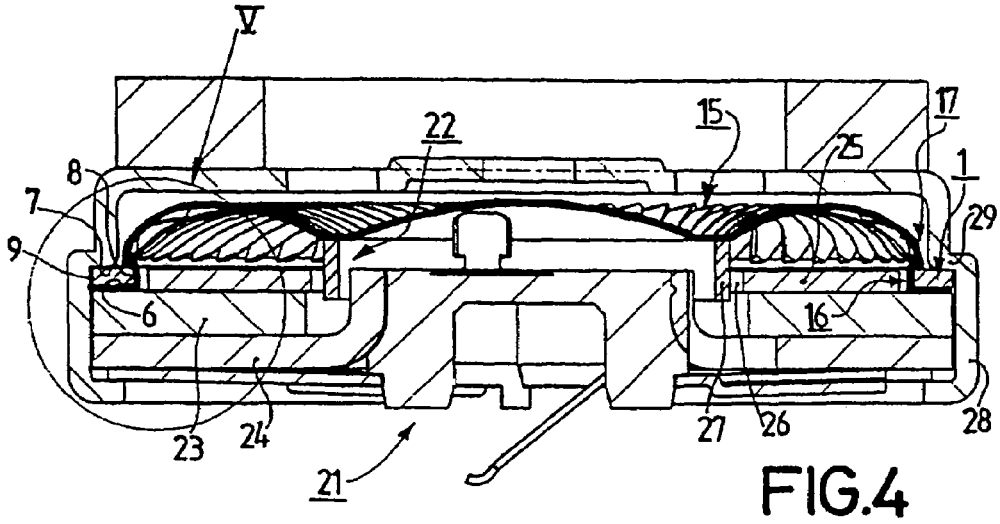

FIG. 4 shows a completed electroacoustic transducer manufactured by the method according to the embodiment of the invention.

Figure 5:
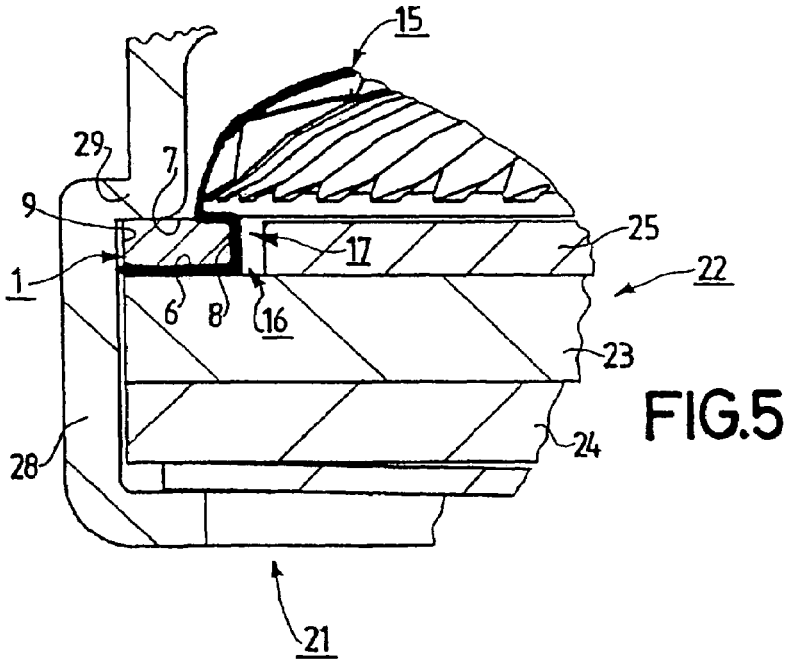

FIG. 5 shows a detail of the electroacoustic transducer of FIG. 1 corresponding to the circle V of FIG. 4 on a larger scale than in FIG. 4.

Wit reference to FIGS. 1 to 3, a method will be described according to an embodiment of the invention for the manufacture of an electroacoustic transducer according to an embodiment of the invention. In the method illustrated in FIGS. 1 to 3 for the manufacture of an electroacoustic transducer, a membrane configuration is produced which consists of a membrane and a handling ring for the membrane connected to the membrane. The membrane configuration is manufactured by a deep-drawing method.

In the deep-drawing method for manufacturing the membrane configuration—as shown diagrammatically in FIG. 1—a handling ring 1 is first introduced into a deep-drawing mold 3 essentially parallel to an axis 2 by means of a gripping and adjustment device 4 indicated diagrammatically with dotted lines in FIGS. 1 to 3. The gripping and adjustment device 4 has a total of three handling pins 5 of which only two handling pins 5 are shown in FIGS. 1 to 3. The deep-drawing mold 3 is formed from a sintered material, which means that the deep-drawing mold 3 is formed so as to be permeable to air, so that any air present between a piece of foil to be molded and the deep-drawing mold 3 can escape through the mold 3. Reference is made to patent document WO 00/5873 A1 in this context.

The handling ring 1 is formed as a flat ring in the present case. The handling ring 1 has a first axial limiting ring surface 6 and a second axial limiting ring surface 7 lying opposite the first axial limiting ring surface 6, and an inner radial limiting ring surface 8 and an outer radial limiting ring surface 9. The two axial limiting ring surfaces 6 and 7 are formed so as to be planar in shape. The two radial limiting ring surfaces 8 and 9 are cylindrical in shape. The ring cross-section is thus rectangular. A handling ring with an oval or circular ring cross-section, however, may also be used.

The handling ring 1 is introduced into the deep-drawing mold 3 by means of the gripping and adjustment device 4 in the direction of an arrow 10, parallel to the axis 2. The handling ring 1 is brought to rest with its first axial limiting ring surface 6 on an annular axial limiting mold surface 11 of the deep-drawing mold 3 in this operation. The handling ring 1 introduced into the deep-drawing mold 3 is axially positioned by means of the annular axial limiting mold surface 11 of the deep-drawing mold 3, the diameter D1 of the radial inner limiting edge 12 of said axial limiting mold surface 11 being greater than the diameter D2 of the inner radial limiting ring surface 8 of the handling ring 1.

As is also clear from FIGS. 1 and 2, the handling ring 1 introduced into the deep-drawing mold 3 is radially positioned by means of a radial limiting mold surface 13 of the deep-drawing mold 3 cooperating with the outer radial limiting ring surface 9 of the handling ring 1. A precise radial and axial positioning of the handling ring 1 in the deep-drawing mold 3 is ensured in this way, using the radial limiting surface 13 and the axial limiting surface 11 of the deep-drawing mold 3.

Subsequently the gripping and adjustment device 4 is removed from the deep-drawing mold 3 against the direction of the arrow 10, the three handling pins 5 being adjusted slightly radially inwards in relation to the handling ring 1 before this movement, so that the handling pins 5 are lifted off the handling ring 1 and thus removed from the deep-drawing mold 3 without adversely affecting the precise positioning of the handling ring 1 in the deep-drawing mold 3.

In further steps of the method of manufacturing an electroacoustic transducer, a piece of foil intended for the manufacture of the transducer membrane is supplied to the deep-drawing mold 3, advantageously in a direction perpendicular to the axis 2. The supply of the piece of foil to the deep-drawing mold 3 is not shown in the Figures.

After the piece of foil for the manufacture of the membrane has been fed to the deep-drawing mold 3, which is heated in a known manner to a given nominal temperature, pressure is exerted on the supplied piece of foil in the direction of the arrow 10, with the result that the piece of foil is pressed into the deep-drawing mold 3 where, due to the porous structure of the deep-drawing mold 3, any air present between the piece of foil and the mold 3 can escape through the deep-drawing mold 3. Pressing the piece of foil into the deep-drawing mold 3 causes the piece of foil intended for the manufacture of the membrane to be molded in the deep-drawing mold 3, giving an intermediate product 14 indicated with dotted lines in FIG. 2 and with solid lines in FIG. 3. When the piece of foil intended for the manufacture of the membrane is shaped in the deep-drawing mold 3, the piece of foil is partly molded into a membrane 15, as is also shown with dotted lines in FIG. 2 and with solid lines in FIG. 3.

An interlocking connection is formed between the handling ring 1 and a foil portion 16 of the piece of foil in the deep-drawing process, and hence in the formation of the piece of foil, whereby the intermediate product 14 is formed, which portion 16 forms part of said membrane configuration 17 comprising the handling ring 1 and the membrane 15. When the piece of foil is shaped in the deep-drawing mold 3 in the present case, the portion 16 of the piece of foil is brought into contact with the handling ring 1 in the area of the inner radial limiting ring surface 8 of the handling ring 1, in the area of the second axial limiting ring surface 7 of the handling ring 1 lying opposite the first axial limiting surface 8 of the handling ring 1, and also in the area of the first axial limiting surface 6 of the handling ring 1, as is shown in FIGS. 2 and 3 and particularly clearly in FIGS. 4 and 5. The result is that the foil portion 16 grips behind the handling ring 1 in the area of the first axial limiting surface 6, whereby an interlocking connection is formed between the handling ring 1 and the foil portion 16, and consequently later the membrane 15. Thus the handling ring 1 and membrane 15 are joined together by an interlocking connection in the present case.

After the handling ring 1 introduced into the deep-drawing mold 3 has been connected to the molded piece of foil, as in the situation shown in FIG. 2, the gripping and adjustment device 4 is moved in the direction of the arrow 10 into the deep-drawing mold 3, where at the end of its insertion the handling pins 5 are adjusted radially outwards so far that the handling pins 5 push against the inner radial limiting ring surface 8 of the handling ring 1, as shown with dotted lines in FIG. 2.

Subsequently the gripping and adjustment device 4 is adjusted against the direction of arrow 10, with the result that the membrane configuration 17 is removed from the deep-drawing mold 3 against the direction of the arrow 10 by the gripping and adjustment device 4. Then the membrane configuration 17 is brought into active connection with a laser cutting device (not shown in the Figures) by the gripping and adjustment device 4.

The laser cutting device (not shown) generates a laser cutting beam 18 as indicated diagrammatically with dotted lines in FIG. 3. The laser cutting beam 18 is directed parallel to the axis 10 onto the membrane configuration 17 such that the laser cutting beam 18 comes into active connection with the membrane configuration 17 in the area of the outer radial limiting ring surface 9, which configuration is then set into rotation in accordance with an arrow 19, with the result that the laser cutting beam 18 separates the excess foil portion 20 from the membrane 15, and consequently the membrane 15 is joined to the handling ring 1 in an interlocking connection, whereby the membrane configuration 17 is produced. In this laser cutting method, the laser cutting beam 18 is directed onto the membrane configuration 17 against the direction of the arrow 10, with the result that the handling ring 1 has a protective function for the area of the membrane 15 lying behind the handling ring 1, viewed in a direction opposed to that of the arrow 10, so that the laser cutting beam 18 has no adverse effect on the membrane 15 in its area joined to the fixing ring 1 in the interlocking connection. The handling ring 1 thus forms a cutting template which fulfills a good protective function and ensures a precise cutting zone.

FIGS. 4 and 5 show an electroacoustic transducer 21 according to the invention. The transducer 21 has a magnet system 22 comprising a permanent magnet 23 with a first yoke 24 and a second yoke 25. Between the first yoke 24 and the second yoke 25 there is an air gap 26 in which a moving coil 27 is present, connected to the membrane 15 of the membrane configuration 17. The magnet system 22 and the membrane configuration 17 have identical external diameters, are held in a housing 28 of the transducer 21, and are exactly aligned both radially and axially by means of the housing 28.

In the transducer 21, the membrane configuration 17 is firmly retained on the permanent magnet 23, which forms a stationary transducer part, by means of a stepped portion 29 of the housing 28. This fastening may alternatively be achieved by means of an adhesive joint.

The membrane configuration 17 in the transducer 21 is formed such that the handling ring 1 and the membrane 15 are joined together by means of an interlocking connection. To form the interlocking connection between the membrane 15 and the handling ring 1, the membrane 15 is brought into contact with the handling ring 1 in a purely interlocking manner, without the use of adhesives or other aids, in the area of the inner radial limiting ring surface 8 of the handling ring 1, in the area of the first axial limiting ring surface 6 of the ring 1, and in the area of the second axial limiting surface 7 of the handling ring 1 opposite the first axial limiting surface 6 of the handling ring 1. As a result the membrane 15 remains axially adjustable in relation to the handling ring 1 in its region lying on the first axial limiting ring surface 6, which is advantageous for obtaining a maximum useful surface area of the membrane 15 which is capable of oscillation.

It should be mentioned that an interlocking connection between the handling ring 1 and the membrane 15 may also be formed in an alternative manner. For example, a handling ring 1 may have axial passages, for example holes or arc-shaped slots, through which, starting from one side of the handling ring, membrane portions be guided so as to terminate at the area of the second side of the handling ring 1 opposite the first side and to engage behind areas of the handling ring 1 in the location of the second side of the handling ring 1.

The invention claimed is:

1. An electro-acoustic transducer with a stationary transducer part and with a membrane configuration comprising a membrane and a handling ring for the membrane connected to the membrane, wherein the membrane configuration is attached to the stationary transducer part by means of the handling ring, and wherein the handling ring and the membrane are joined together by means of an interlocking connection, the interlocking connection between the membrane and the handling ring is obtained in that the membrane is kept in contact wit the handling ring in the area of an inner radial limiting ring surface of the handling ring, in the area of a first axial limiting ring surface of the handling ring, and in the area of a second axial limiting ring surface of the handling ring opposite the first axial limiting ring surface of the handling ring.

* * * * *